United States Patent [19]

Hvizdos et al.

[11] 4,179,897

[45] Dec. 25, 1979

[54] ISENTROPIC EXPANSION OF GASES VIA A PELTON WHEEL

[75] Inventors: Leonard J. Hvizdos, Emmaus; Richard E. Filippi, Allentown; Richard E. Luybli, Hellertown, all of Pa.

[73] Assignee: Air Products & Chemicals, Inc., Allentown, Pa.

[21] Appl. No.: 607,226

[22] Filed: Aug. 25, 1975

[51] Int. Cl.[2] ..... F25J 1/00

[52] U.S. Cl. ..... 62/9; 62/38

[58] Field of Search ..... 62/38, 9

[56] References Cited

U.S. PATENT DOCUMENTS

| | | | |
|---|---|---|---|
| 2,082,189 | 6/1937 | Twomey | 62/23 |
| 2,552,451 | 5/1951 | Patterson | 62/39 X |
| 2,814,936 | 12/1957 | Morrison | 62/38 |
| 2,900,796 | 8/1959 | Morrison | 62/38 |
| 3,210,948 | 10/1965 | Schilling | 62/38 X |
| 3,216,206 | 11/1965 | Kessler | 62/38 |
| 3,348,384 | 10/1967 | Harmens | 62/38 |
| 3,383,873 | 5/1968 | Becker | 62/38 X |
| 3,433,026 | 3/1969 | Swearingen | 62/38 |
| 3,609,984 | 10/1971 | Garwin | 62/38 |

*Primary Examiner*—Norman Yudkoff

*Attorney, Agent, or Firm*—Russell L. Brewer; Barry Moyerman

[57] ABSTRACT

This invention relates to an improved isentropic process for liquefying a gas, preferably a cryogenic fluid, which comprises forming a critical fluid, expanding the critical fluid through a Pelton Wheel to a pressure below the critical pressure forming a liquefied gas and removing work. The improvement for enhancing the efficiency of the Pelton Wheel in removing work comprises:

withdrawing the liquefied gas from the Pelton Wheel at its saturation temperature or at a temperature below its saturation temperature, and establishing and maintaining a vapor environment about the Pelton Wheel by the method selected from the group consisting of injecting a second gas into the Pelton Wheel, said second gas being introduced into the Pelton Wheel at the saturation temperature or at a temperature slightly above the saturation temperature of the liquefied gas; and raising the enthalpy of the liquefied gas after it has been withdrawn from the Pelton Wheel to an enthalpy above the enthalpy of saturated liquid.

6 Claims, 3 Drawing Figures

ISENTROPIC EXPANSION OF GASES VIA A PELTON WHEEL

BACKGROUND OF THE INVENTION

The field of low temperature processes i.e., those at temperatures below about −100° F. used for the recovery of liquefied gases or for the separation of gases such as air has grown to considerable importance in recent years. The products have found considerable usage in a variety of operations. For example, oxygen is recovered from liquefied air and is used in basic oxygen furnaces and open hearth furnaces found in steel mills and it is used to enrich the air for fuels suited for the field of welding and cutting of metals. Nitrogen is recovered from air and is used as an inert gas, as a refrigerant or as a raw material for the synthesis of ammonia. Argon and other rare gases are recovered from air and used for welding purposes and display signs.

Recently, in view of the domestic energy shortage, and high demands at certain times, storage vessels and cryogenic cycles have been developed for providing both base and peak load quantities of liquefied natural gas during these periods. Consequently, large quantities of natural gas are liquified near the well site and shipped in liquid form to points of usage.

In these low temperature processes, large quantities of refrigeration are required in order to liquefy the gases. Typically, three processes have been used for effecting refrigeration of gases and comprise: (1) heat exchange of gas to be refrigerated against the vaporization of a liquid, (2) the utilization of the Joule-Thompson effect in gases, and (3) the expansion of gas in an engine doing external work. A widely used method for large scale production of gas is the third method in which external work is removed on expansion of the gas in expansion engine. This approach is often referred to as an isentropic expansion whereas the Joule-Thompson method is referred to as an isenthalpic expansion.

DESCRIPTION OF THE PRIOR ART

As noted in U.S. Pat. No. 2,552,451, prior art expansion engines have been operated under conditions whereby on expansion the temperature of the gas in the expander is maintained at or above the saturation point from inlet to discharge. If liquid is formed in the expander prior to discharge, adverse results in terms of engine knocking and failure can result.

Other systems which employ a gas expander for doing external work are shown in U.S. Pat. No. 3,066,492; U.S. Pat. No. 3,194,026; U.S. Pat. No. 2,494,120; and U.S. Pat. No. 3,377,811. In each of these patent applications, the inlet temperature and pressure is chosen so that little, if any, liquid is formed at the outlet of the expander.

It has been proposed to use a Pelton Wheel as a hydraulic turbine or motor in order to effect liquefaction of gases and its operation is shown in U.S. Pat. No. 3,203,191. Like previous operations employing hydraulic motors, a single phase is present in the operation of the Pelton Wheel. In this particular patent, a liquid is maintained in the Pelton Wheel by maintaining back pressure on the motor in excess of the saturation pressure of the liquid.

SUMMARY OF THE INVENTION

Broadly, the invention relates to an improvement in an isentropic process for liquefying a first gas, preferably those cryogenic gases having a boiling point below about −100° F. by forming a critical fluid, expanding the critical fluid through a Pelton Wheel to a pressure below the critical pressure and removing work. The improvement comprises;

withdrawing the first gas from the Pelton Wheel at its saturation temperature or at a temperature below its saturation temperature, and establishing and maintaining a vapor environment about the Pelton Wheel by the method selected from the group consisting of injecting a second gas into the Pelton Wheel with the second gas being injected at a temperature at least the saturation temperature of the first gas or at a temperature slightly above the saturation temperature of the first gas; and raising the enthalpy of the liquefied first gas after it has passed through the Pelton Wheel to an enthalpy above the enthalpy of the saturated liquid.

Advantages of this invention include:

the ability to use a simple hydraulic turbine namely the Pelton Wheel with greater efficiency for performing work and thereby enhancing the amount of refrigeration obtainable in the liquefaction of gases; and the ability to use a Pelton Wheel in a variety of liquefaction processes such as in an air separation plant or in a plant where Joule-Thompson expansion devices were used to the exclusion of hydraulic turbines.

THE DRAWINGS

DESCRIPTION OF THE PREFERRED EMBODIMENTS

Figure 1:
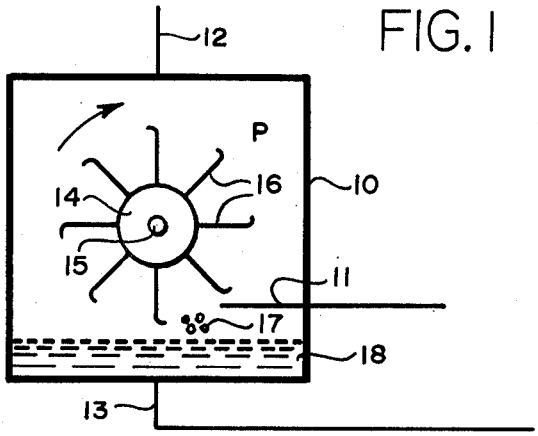
FIG. 1 is a view in elevation of a hydraulic turbine comprising a Pelton Wheel showing the necessary equipment lines for operation.

Referring to the drawings, FIG. 1 is a view of a hydraulic motor of the Pelton Wheel type comprising a housing 10 a first gas inlet 11, a second gas inlet 12 and a liquid outlet 13 and a Pelton Wheel 14. Pelton Wheel 14 is supported on shaft 15 in housing 10. Pelton Wheel 14 has a plurality of radially extending curved paddles on which the liquefied gas can impinge and cause the Pelton Wheel to rotate. Generally shaft 15 is connected to a high speed compressor or other device in order to permit the Pelton Wheel to do work while in operation.

Prior to effecting substantially isentropic expansion of a gas and removing work in the apparatus of FIG. 1, a gas e.g. helium, air, ethylene, hydrogen, oxygen, nitrogen, ammonia, methane, argon, neon, ethane, propane, propylene and carbon monoxide is compressed and cooled sufficiently to permit liquefaction after isentropic expansion. Generally the gas is compressed to a pressure above the critical pressure and cooled to a temperature below the critical temperature thus forming a critical fluid. As viewed from a pressure-enthalpy diagram a critical fluid is in the upper left hand region as opposed to the upper right hand region where most isentropic expansions have been conducted in the past. In most situations the conditions for isentropic expansion are selected in the critical fluid region so that there will be an opportunity to obtain a substantial change in enthalpy on expansion of the gas. It of course would be obvious that if the conditions were selected such that there would be little change in enthalpy during the isentropic expansion process i.e. where the entropy lines are substantially vertical very little work could be removed and the hydraulic turbine would be doing nothing more than a Joule-Thompson expansion.

Again referring to FIG. 1, after the gas has been compressed and cooled to a point in the critical fluid region, the gas is directed into housing 10 via inlet 11. Inlet 11 is a nozzle and is aimed so that the liquid 11*a* exiting the nozzle impinges in the center of the paddles on Pelton Wheel 14 causing it to rotate. The kinetic energy of the liquefied gas as it leaves the nozzle is converted into mechanical energy by the Pelton Wheel. This mechanical energy is converted into work usually by a compressor, or generator (not shown) which is attached to shaft 15 supporting the Pelton Wheel.

Two essential environmental conditions are maintained in housing 10 and about Pelton Wheel 14 during the liquefaction of the first gas. First, the conditions are controlled so that substantially single phase liquid droplets 17 are formed and withdrawn from Pelton Wheel 14. Preferably liquid droplets 17 fall from the paddles in a subcooled state e.g. 1°–5° and more preferably from about 1°–2°. By subcooled it is meant that the droplets are at a temperature below the saturation temperature. It is important to withdraw the droplets at their saturation temperature or below and not above. If the temperature of droplets substantially exceeds the saturation temperature then the droplets are present as two phases comprising gas and liquid. The generation of a two phase system in a substantial amount e.g. greater than about 10% in Pelton Wheel, 14, as opposed to housing 10, may retard rotation of the Pelton Wheel, thereby reducing the efficiency and may cause wear, and perhaps engine failure.

The second essential condition for improving the efficiency of the Pelton Wheel is the establishment and maintaining of a vapor environment about the wheel. This can be accomplished by two methods.

The first method comprises injecting a second gas into housing 10 through second inlet 12 at a temperature slightly above the saturation temperature or at the saturation temperature of the first gas. Naturally it would be advantageous to introduce the gas at precisely the saturation temperature to minimize the amount of heat introduced into the system. However, it often is difficult to control the temperature of the gases with that degree of accuracy and therefore the temperature of the second gas as it is introduced is generally about 1° to 4° above the saturation temperature.

Because the liquid droplets as they fall from the Pelton Wheel are in a subcooled state they tend to cool the gas around the Pelton Wheel. If the second gas is the same as the first gas, then the second gas will cool and condense and additional gas must be supplied to make up the losses through condensation. This can be done by connecting second inlet 12 to the vapor side of the storage tank for the liquefied gas. With continuous access to a vapor source the Pelton Wheel will consume the gas as needed.

On the other hand, it is possible to use a second gas of different composition from the first gas. Preferably the gas is inert and insoluble with respect to the first gas. By inert it is meant that there should be no chemical reaction between the second gas and the first gas. The second gas should also be insoluble in the first gas under the process conditions so that the first gas is not contaminated by the second gas. By insoluble it is meant that very little of the second gas will condense out at the process conditions and thereby contaminate the first gas. For example, helium could be used as a second gas for forming a vapor environment about a Pelton Wheel in the liquefaction of hydrocarbons, oxygen, nitrogen, ammonia and the like.

When the second gas is dissimilar to the first gas, it is possible to inject the gas into the housing of the Pelton Wheel at a temperature below the saturation temperature of the first gas. However, because of the substantial amount of liquefied gas being passed through the Pelton Wheel in terms of the second gas used for forming the vapor environment, the second gas is warmed rapidly to about the saturation temperature of the first gas. Because of this inherent warming of the second gas, assuming it is introduced into the housing at a temperature below the saturation temperature of the first gas, such conditions are regarded as injecting the gas at the saturation temperature of the first gas.

A second method for forming a vapor environment about Pelton Wheel 14 and housing 100 is to control the expansion of the critical fluid through the Pelton Wheel utilizing the inefficiencies in the Pelton Wheel e.g., heat leaks and friction losses to raise the enthalpy of liquid layer 18 to an enthalpy at its saturation temperature or to an enthalpy slightly above the saturation temperature thereby generating a vapor. This vapor then is exhausted through inlet 12. Other conditions in Pelton Wheel 14 i.e., the removal of droplets 17 remain the same.

The generation of gas from the liquid layer below the Pelton Wheel is contrasted with the generation of a two phase system as the liquid impinges against the curve blades or paddles of the Pelton Wheel. When the gas is generated from the liquid layer, below there is very little tendency to reduce the efficiency of the unit. On the other hand, the generation of a two phase system in the nozzle or Pelton Wheel may reduce the efficiency.

Because temperature control in the system is difficult to maintain within one to two degrees, there may be instances during the operation of the Pelton Wheel where gas is drawn into the housing by the condensing of the gas around the Pelton Wheel into the liquid layer below and sometimes there may be slight exhausting of the gas from the housing due to gas generation from the liquid layer below the Pelton Wheel. Because of the probability of both conditions being present during continuous operation of the Pelton Wheel, it is preferred that the gas used for establishing the vapor environment about the Pelton Wheel be the same composition as the gas to be liquefied.

The following examples are provided to illustrate preferred embodiments of the invention and are not intended to restrict the scope thereof.

EXAMPLE 1

Figure 2:
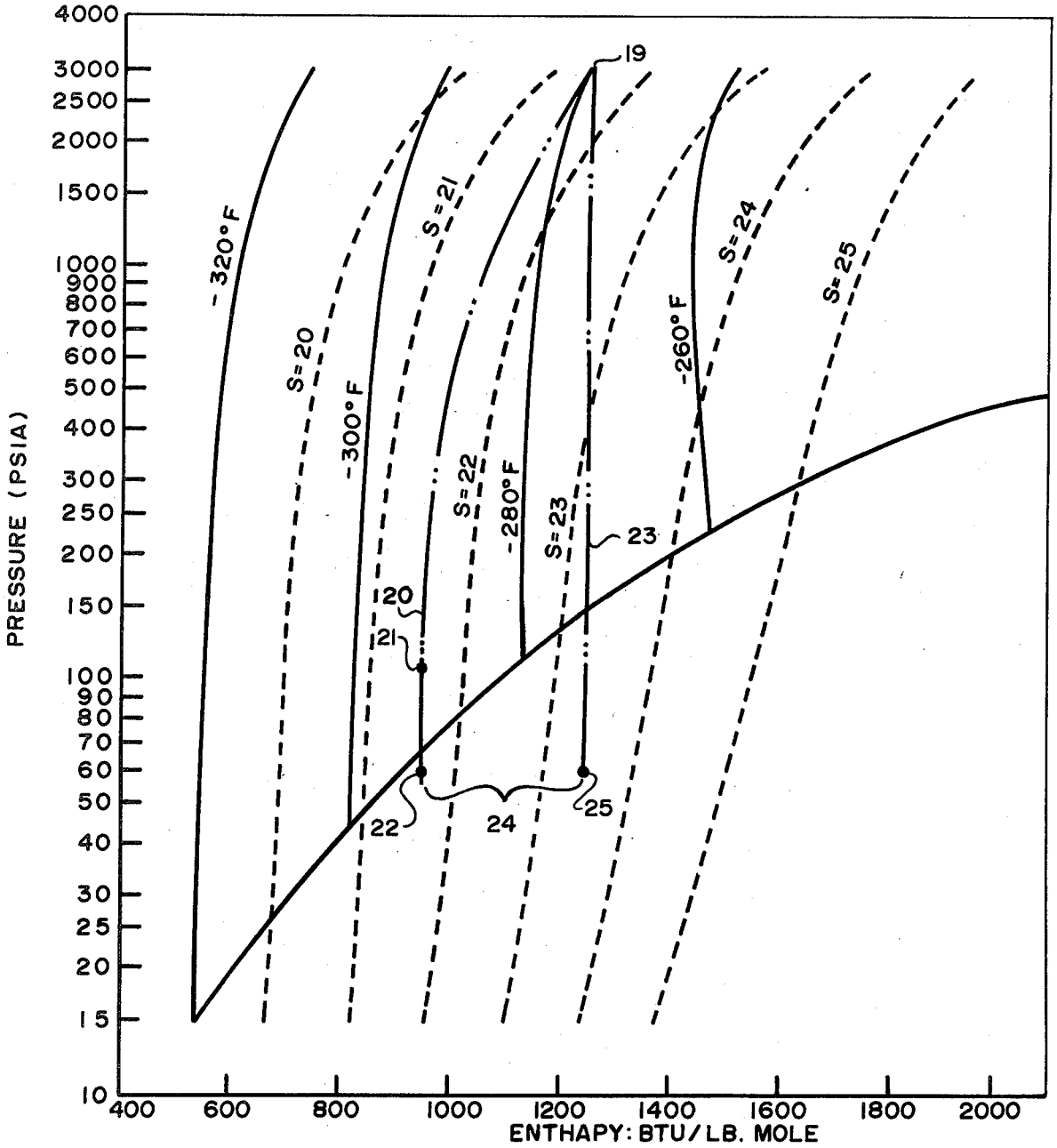
FIG. 2 is a view of a portion of a pressure-enthalpy diagram for nitrogen with exemplary process conditions shown.

In referring to FiG. 2 which is a pressure-enthalpy diagram for nitrogen, nitrogen gas is prepared for liquefaction by compressing it to a pressure of 3,000 psi and cooling to a temperature of about −279° F. thus forming a critical fluid as indicated at 19. These conditions are pre-selected so that it is possible to take advantage of the substantial change in enthalpy that will result in a substantially isentropic expansion of the gas. The nitrogen gas then is substantially isentropically expanded as shown by curve 20 to a pressure of about 106 psi as indicated at point 21. At point 21 the pressure of the liquefied gas is slightly above the saturation pressure or alternatively stated the temperature is slightly below the saturation temperature. Thus, droplets of liquefied nitrogen are formed and withdrawn from the Pelton Wheel in a sub-cooled state i.e. at a temperature of about −285° F.

Nitrogen gas at a temperature of about −282° F., which is about the saturation temperature is introduced into the Pelton Wheel through inlet 12 in FIG. 1 to provide a vapor environment in which the Pelton Wheel can spin. Because the temperature of the liquefied nitrogen as it is withdrawn from the Pelton Wheel is below the saturation temperature and because the temperature of the nitrogen gas injected into the Pelton Wheel is slightly above the saturation temperature there is a tendency for the nitrogen gas surrounding the Pelton Wheel to condense into the liquid layer below which is about at its saturation temperature. Thus a continuous supply of nitrogen must be available and fed into the Pelton Wheel in order to maintain a vapor environment.

If the Pelton Wheel did not have access to a separate vapor stream for maintaining a vapor environment, the sub-cooled liquid would condense the vapor above the Pelton Wheel and the liquid level would rise in the Pelton Wheel housing thereby submerging the Pelton Wheel. As stated before, enhanced efficiency of the Pelton Wheel can be achieved by spinning the wheel in a vapor as opposed to spinning it in a liquid.

With the liquefied gas at about 106 psi and a temperature of about −285° F., additional cooling can be generated by expanding the liquid gas through a Joule-Thompson valve (an isenthalpic expansion) to a desired product pressure e.g. 60 psi as shown at point 22. The Pelton Wheel is not used to effect expansion from point 21 to point 22 as this would result in the generation of a vapor which could lead to adverse results. Additionally because the enthalpy line is substantially vertical from point 21 to 22 very little work would be obtained by the expansion.

The advantages of the process of this invention i.e. effecting an isentropic expansion as opposed to an isenthalpic expansion for obtaining a greater quantity of liquid is shown by comparing the results obtained by an isenthalpic expansion under the same conditions as shown by line 23. The distance 24 between points 22 and 25, which is the final expansion pressures of the isentropic and isenthalpic expansion processes respectively, indicates the additional amount of liquid that is formed. Under these conditions it appears that about 13% more liquid is obtained by the isentropic expansion. Overall efficiency of the Pelton Wheel spinning in a vapor environment is about 75% or greater whereas the efficiency of conventional hydraulic turbines or a Pelton Wheel spinning in a liquid is substantially lower.

EXAMPLE 2

Figure 3:
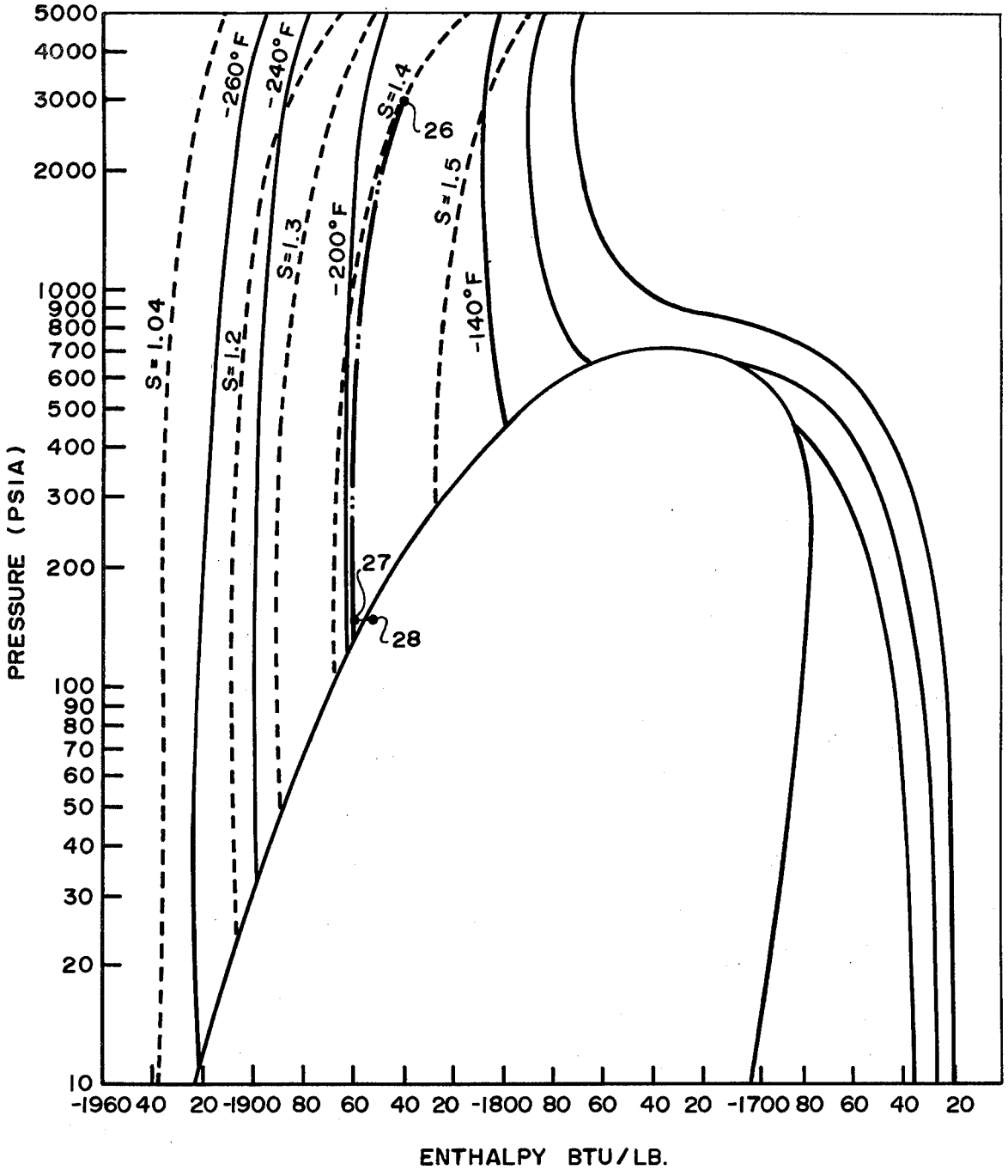
FIG. 3 is a view of a portion of a pressure enthalpy curve for methane with exemplary process conditions shown.

Referring to FIG. 3, which is a pressure-enthalpy diagram for methane, methane is prepared for liquefaction by compressing to a pressure of 3,000 psi and cooling to a temperature of about −180° F. thus forming a critical fluid as identified at point 26. The critical fluid is expanded at substantially constant entropy to a pressure of about 140 psi. The exit temperature of the liquefied gas as it drops from the curved blades of the Pelton Wheel is about −195° F. as identified at point 27. This is about 2.0° below its saturation temperature.

Although the nozzle is about 96% efficient, the Pelton Wheel including the housing, is not as efficient thereby resulting in an overall engine efficiency of about 75%. These inefficiencies can be utilized to raise the enthalpy of the liquid layer below the Pelton Wheel, but still in the housing to an enthalpy above the saturated liquid line or alternatively stated to a temperature slightly above its saturation temperature e.g., −195° F. as identified at point 28. By raising the enthalpy of the liquid layer, gas is generated and a vapor environment is formed in which the Pelton Wheel can spin. Thus, by carefully controlling the exit condition of the liquefied gas as it leaves the nozzle and by experimentally determining the inefficiencies in the engine, it is possible to utilize the heat from inefficiencies as opposed to adding heat to raise the enthalpy of the liquid sufficiently to generate a gaseous vapor in which the Pelton Wheel can rotate. Enhanced engine efficiencies are obtained by this process of permitting the Pelton Wheel to spin in a vapor.

What is claimed is:

1. A process for liquefying a first gas which comprises the steps:

compressing said first gas to a pressure above its critical pressure and cooling to a temperature below its critical temperature;

isentropically expanding the first gas through a Pelton Wheel turbine, said Pelton Wheel turbine being mounted and enclosed in a sealed housing, said expanding being conducted under conditions such that (a) substantially all of the critical fluid is converted to a liquid at its saturation temperature or at a temperature below its saturation temperature, and (b) a vapor environment is maintained in the housing and about the Pelton Wheel turbine by injecting a second gas into the housing, said second gas being at the saturation temperature or at a temperature above the saturation temperature of the liquefied first gas.

2. The process of claim 1 wherein said second gas is different from said first gas said second gas being insoluble and substantially noncondensable in said first gas.

3. The process of claim 1 wherein said second gas is the same as said first gas.

4. The process of claim 3 wherein said first and second gas are nitrogen.

5. The process of claim 3 wherein said first and second gas is air.

6. The process of claim 3 wherein said first and second gas is methane.

* * * * *